United States Patent [19]

Anselrode

[11] 4,115,234

[45] Sep. 19, 1978

[54] ELECTROPHORETIC TRANSFER PROCESS

[75] Inventor: Lodewijk Anselrode, St. Anthonis, Netherlands

[73] Assignee: Stork Brabant B.V., Boxmeer, Netherlands

[21] Appl. No.: 672,678

[22] Filed: Apr. 1, 1976

[30] Foreign Application Priority Data

Apr. 17, 1975 [NL] Netherlands ..... 7504599

[51] Int. Cl.[2] ..... C25D 1/12

[52] U.S. Cl. ..... 204/180 R; 204/181 R; 204/299 EC; 204/300 EC

[58] Field of Search ..... 96/1.4; 204/181, 180 R, 204/299, 181 PE, 2; 427/24

[56] References Cited

U.S. PATENT DOCUMENTS

| | | | |
|---|---|---|---|
| 2,083,441 | 6/1937 | Frost | 204/2 X |
| 3,145,156 | 8/1964 | Oster | 204/180 R |
| 3,372,102 | 3/1968 | Lennon | 204/180 R |
| 3,409,528 | 11/1968 | Lennon | 204/180 R |
| 3,471,387 | 10/1969 | Lennon et al. | 204/180 R |
| 3,647,659 | 3/1972 | Keller et al. | 204/181 PE |
| 4,013,531 | 3/1977 | Nakamura et al. | 204/181 |
| 4,023,968 | 5/1977 | Amidon et al. | 204/181 X |

*Primary Examiner*—Arthur C. Prescott

*Attorney, Agent, or Firm*—Watson, Cole, Grindle & Watson

[57] ABSTRACT

A method and a device for the transfer of a design of dye stuff particles in a moist environment from a carrier element to a receiving material in contact with said carrier, while using an electric field; the receiving material is previously impregnated with a thickening agent having a high molecular weight and hereafter dried by means of a rise in temperature previous to its entering into contact with said carrier.

10 Claims, 2 Drawing Figures

ELECTROPHORETIC TRANSFER PROCESS

BACKGROUND OF THE INVENTION AND DISCUSSION OF THE PRIOR ART

My invention relates to electrophoretic transfer processes in which a substance is transferred from a carrier material to a receiving material in contact with the carrier material. It is particularly but not exclusively applicable to the transfer printing of patterns on textile materials. A process of this type is disclosed in U.S. Pats. Nos. 3,145,156 and 3,409,528.

During such transfer processes, an electric field is applied to the carrier and receiving materials, in a direction normal to their surfaces. This promotes the travel of the substance to be transferred in this direction, without at the same time promoting its lateral travel. Thus, when a pattern is being transferred to the receiving material, the sharpness of the pattern is largely maintained but the penetration depth of particles of different sizes is unequal. As a consequence the symptom occurs that after having performed the method the dyestuffs are present at different levels in the receiving material. A somewhat different transfer process without using an electric field is disclosed in British Pat. No. 1,284,824.

SUMMARY OF THE INVENTION

My invention provides an electrophoretic transfer process in which at least one substance is transferred, in a moist environment and in an electric field, from a carrier material to a receiving material held in contact with the carrier material, the transfer being preceded by impregnation of the receiving material with a thickening agent of high molecular weight preferably greater than $10^6$, and drying of the receiving material before it is brought into contact with the carrier material.

The thickening agent exerts a braking effect on the molecules of the dyestuff or other substance being transferred. This helps to minimise differences in the depth of penetration into the receiving material and in the sharpness of different parts of the pattern which might otherwise be caused by differences in the speed of travel of the molecules of different substances. These differences in speed may result from, for example, differences in the size of the molecules or differences in their charges. The effectiveness of the braking action is improved by drying the impregnated cloth before the transfer is performed.

In printing textile and the like material, such as nonwovens, it is necessary that the printed textile web is passed through an after treatment, for instance steaming during which the textile web is brought into contact with vapour of 100° C for some times, e.g. 20 minutes. This treatment is required for obtaining a fixation of the dyestuff in the fibers of the web. A further surprising aspect of the invention consists in that on performing the previously defined method, the dyestuffs are not only transported from the carrier into the receiving material, but are also fixed to the fibers during the electrophoretic process. A possible explanation of this favourable phenomenon can be found by the heat development which arises as a consequence of the passage of electric current through the super imposed layers of material.

Preferably the receiving material is impregnated with a mixture of the thickening agent and a fixing agent. This allows the whole process of transfer and fixing to be completed quickly. The electric field applied to the carrier material and the receiving material will result in an electric current through these materials, and this will result in heating of the materials, which promotes fixing of the transferred substance. By selecting an appropriate value for the applied voltage, the materials may be heated to 100° C, so that drying of the materials is also promoted. A higher temperature can be reached if the carrier material and the receiving material are subjected to pressure over at least part of their area of contact while the electric field is applied. In many cases, fixing can be satisfactorily completed within 30 to 60 seconds; this represents a considerable saving of time in comparison with other methods of fixing.

In one possible arrangement, the carrier material is used as an electrode for applying the electric field.

Preferably the carrier material and the receiving material are guided to travel along paths which coincide along a transfer section, along which the bands move between two moist absorbent surfaces while being subjected to the electric field.

In a particularly preferred arrangement, the transfer section comprises a major part of the circumference of a rotatable drum, and the two moist absorbent surfaces comprise two endless absorbent belts which are wrapped around the transfer section, the remainder of the length of the belts being guided to travel in a path which passes through a liquid bath, and the carrier material and the receiving material are in the form of elongate bands which are guided to pass around the transfer section between the absorbent belts, and a conductive belt is wrapped around the outside of the absorbent belts along the transfer section to form an electrode for applying the electric field.

The conductive belt may be provided with tensioning means. This allows the carrier material and the receiving material to be subjected to pressure, so that, as mentioned above, a temperature greater than 100° C can be attained. The conductive belt may be of a porous material; this allows steam to escape easily from the receiving material, so that it can dry while it is still subjected to the electric field.

SURVEY OF THE DRAWINGS

FIG. 1 is a diagrammatic view of an arrangement which can be used for discontinuous transfer printing; and FIG. 2 is a diagrammatic view of an arrangement which can be used for continuous transfer printing.

DESCRIPTION OF A PREFERRED EMBODIMENT TOGETHER WITH SOME EXAMPLES OF THE METHOD

Figure 1:
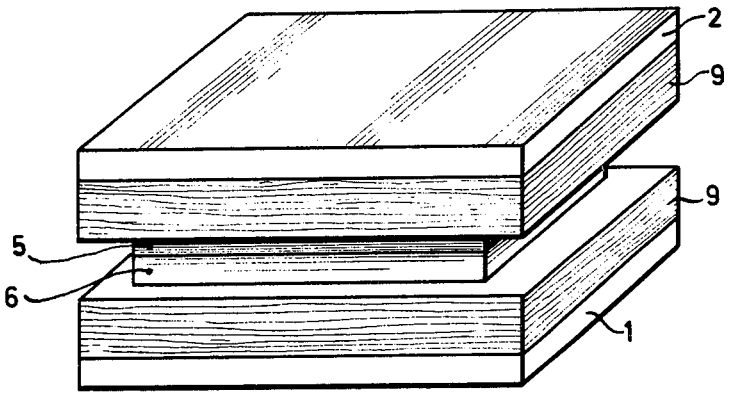

FIG. 1 illustrates one way in which a transfer printing process employing my invention can be carried out. The arrangement shown in FIG. 1 comprises two plate electrodes 1 and 2, between which are sandwiched, in the following order, a layer 9 of absorbent material, a design carrier 6 on which a design has already been printed, a textile material 5 to which the design is to be transferred, (the printed side of the carrier 6 faces the material 5), and a second layer 9 of absorbent material. The layers 9 of absorbent material are moistened with water before the sandwich is assembled. To cause the transfer of the design from the carrier 6 to the material 5, a voltage is applied across the electrodes 1 and 2. This results in an electrophoretic transfer of the dyestuffs from the design carrier 6 to the material 5. The resulting current through the sandwich also heats and then boils the water contained in the layers 9; this assists in the fixing of the dyestuffs in the material 5.

Before the sandwich is assembled, the material 5 to be printed is impregnated with a high molecular weight thickening agent, and then dried. Because the mobility of the particles of the dyestuffs during the transfer process is then largely controlled by the thickening agent, and not by differences between the different dyestuffs, the dyestuffs will penetrate to a fairly uniform depth into the material 5.

Particular examples of transfer printing processes will now be described. The examples show the use of acid, basic, reactive, and anionic pigment dyestuffs; Tables A, B, C and D respectively list a number of each of these types of dyestuffs. In these tables, the manufacturer's name for each dyestuff and the color index "generic name" are given; the color index "constitution number" is also given, in brackets after the generic name, if it is known.

TABLE A

| ACID DYESTUFFS | |
|---|---|
| Manufacturer's name of dyestuff | C.I. number |
| Telonechtkupferrot RL | C.I. Acid orange 51 (26550) |
| Telonechtrot BF | C.I. Acid red 161 (18035) |
| Telonechtorange ACT | C.I. Acid orange 116 |
| Telonechtblau AFN | C.I. Acid blue 264 |
| Telonechtrubin A5BL | C.I. Acid red 299 |
| Telonechtgelb ARL | C.I. Acid yellow 64 |
| Telonlichtblau GGL | C.I. Acid blue 40 |
| Telonlichtrot BL | C.I. Acid red 42 |
| Telonechtorange G | C.I. Acid orange 33 (24780) |
| Telonechtbordo O | C.I. Acid red 134 (24810) |
| Telonechtgrun 6G | C.I. Acid green 81 |
| Telonechtblau ESN | C.I. Acid blue 221 |
| Telonechtgelb A2RL | C.I. Acid yellow 159 |
| Telonlichtgelbbraun 3G | C.I. Acid brown 248 |
| Telonlichtorange 3GT | C.I. Acid orange 3 |
| Telonechtmarineblau R | C.I. Acid blue 113 (26360) |
| Telonechtmarineblau G | C.I. Acid blue 120 (26400) |
| Telonechtblau 5G | C.I. Acid blue 232 |
| Nylosangelb N-7GL | — |
| Nylosangelb N-CTL | — |
| Nylosangelb LNW | — |
| Nylosangelb N-3RL | C.I. Acid orange 67 |
| Nyloanviolet F-BL | C.I. Acid violet 48 |
| Nylosanviolet 2FR | C.I. Acid violet 31 |
| Nylosanrot F-5B | C.I. Acid red 143 |
| Nylosanrot N-2RBL | C.I. Acid red 336 |
| Nylosanblau 2GLF | C.I. Acid blue 181 |
| Nylosanrubin N-5BL | C.I. Acid red 299 |
| Nylosanbrillant grun F-6GL | — |
| Nylosanorange N-RL | C.I. Acid orange 127 |

TABLE B

| Liquid Basic Dyestuffs | |
|---|---|
| Manufacturer's name of dyestuff | C.I. Number |
| Maxilonbrillantflavin 10 GFF | C.I. Basic yellow 40 |
| Maxilongelb 6GL | C.I. Basic yellow 21 |
| Maxilongelb GL 50% | C.I. Basic yellow 45 |
| Maxilonorange 2GL | C.I. Basic orange 43 |
| Maxilongelbbraun 2GL 50% | C.I. Basic brown 14 |
| maxilonrot GRL 50% | C.I. Basic red 46 |
| Maxilonrot BL | C.I. Basic red 22 |
| Maxilonbrillantrot 4G 200% | C.I. Basic red 14 |
| Maxilonbrillantrosa B | C.I. Basic red 27 |
| Maxilonbordeaux 2BL 50% | C.I. Basic red 59 |
| Maxilonblau 3RL | C.I. Basic blue 80 |
| Maxilonblau BL | C.I. Basic blue 22 |
| Maxilonblau GRL | C.I. Basic blue 41 |
| Maxilonblau 5G | C.I. Basic blue 3 (51004) |

TABLE C

| REACTIVE DYESTUFFS | |
|---|---|
| Manufacturer's name of dyestuff | C.I. Number |
| Levafix brillantblau E-B | C.I. reactive blue 29 |
| Levafix gelb E-GR | C.I. reactive yellow 82 |
| Levafix goldgelb E-G | C.I. ractive yellow 27 |
| Levafix rubin E-FB | C.I. reactive red 37 |
| Levafix brillantrot E-2B | C.I. reactive red 41 |

TABLE C-continued

| REACTIVE DYESTUFFS | |
|---|---|
| Manufacturer's name of dyestuff | C.I. Number |
| Levafix blau P-3GL | C.I. reactive blue 54 |
| Levafix brillantblau P-RL | C.I. reactive blue 65 |
| Levafix turkisch P-GA | — |
| Levafix blau P-RA | C.I. reactive blue 104 |
| Levafix brilantgelb P-3GA | C.I. reactive yellow 25 |
| Levafix brillantgelb P-GG | C.I. reactive yellow 52 |
| Levafix rot P-GA | C.I. reactive red 119 |
| Levafix brillantrot P-B | C.I. reactive red 80 |
| Levafix goldgelb P-R | C.I. reactive orange 42 |

TABLE D

| Anionic Pigment Dyestuffs |
|---|
| Manufacturer's name of dyestuff |
| Acramin brown FRL |
| Acramin yellow FGRN |
| Acramin blue FFG |
| Acramin black FPV |
| Acramin orange FG |
| Acramin violet FRR |
| Acramin red FBC |

EXAMPLE 1

Printing on Polyamide with Acid Dyestuffs.

A three-color design was printed on a highly absorbent paper (Cobb value 1 min. = 70) to form the design carrier 6. The following dyestuffs from Table A were used.

Nylosanblau 2GLF
Nylonsanorange N-RL
Telonechtgelb A2 RL

The dye pastes used were of the following composition:

| Ingredient | Parts by weight |
|---|---|
| Dyestuff | 75 |
| Glyezin A | 75 |
| Lyocol BC | 20 |
| Water | 350 |
| | + 460 |
| Solvitose MVS | 40 |
| Respumiet CA 3300 | 5 |

Glyezin A is a thio diethylene glycol produced by BASF. Lyocol BC is a glycol-like chemical produced by Sandoz. Solvitose MVS is a high polymer colloid produced by Scholten. Respumiet CA 3300 is a silicone base anti-foaming agent produced by Bayer.

The dye pastes were prepared by the following method. The Glyezin A, the Lyocol BC and 350 parts of water were mixed and heated to 100° C. The dyestuff was then stirred in. After cooling, the mixture was mixed with the Solvitose MVS, and then with 460 parts of water, so that the viscosity was reduced to a suitable value. Finally, the Respumiet CA 3300 was added.

A polyamide fabric was impregnated with the following mixture to form the fabric 5 to be printed:

| Ingredient | Parts by weight |
|---|---|
| Solvitose C 5 10% | 500 |
| water | 445 |
| ammonium sulphate solution 1:1 | 50 |
| sodium metanitrobenzenesulphonate | 5 |

The fabric impregnated with this thickening agent having a molecular weight of more than $10^6$, was then dried at a temperature of about 80° C.

The fabric was then printed with the design on the design carrier, using the arrangement shown in FIG. 1. The size of the fabric 5 and the design carrier 6 was 10 cm square: the size of the layers 9 and the electrodes 1 and 2 was 15 cm square. The layers 9 were of uncolored needle felt, and were saturated with tap water before the sandwich was assembled. After being assembled, the sandwich was compressed with a pressure of 25 kgf (higher pressures could, of course, be used), and a direct voltage of 250 V was applied between the electrodes 1 and 2, the electrode 1 being negative and the electrode 2 positive. Because of the moisture in the layers 9, the resistance between the electrodes 1 and 2 was fairly low at first, and a current of about 10 amps passed between the electrodes. The electrical power dissipated in the assembly raised its temperature to 100° C in about 15 seconds, after which the current passing between the electrodes fell because of the evaporation of the water; after 1 minute, the current was between 1 and 2 amps, and at this point, the transfer printing process was ended. The assembly is then almost dry, about 90% of the water having been eva-porated.

During the process, the dyestuff was transferred electrophoretically from the design carrier 6 to the textile material 5, where it is in effect retained by the Solvitose CS and fixed. The fastness of the color was about the same as with directly printed polyamide which, after drying, is fixed for 30 minutes in saturated steam at 102° C.

EXAMPLE 2

Printing on Wool with Acid Dyestuffs

As with both wool and polyamide the fixing of acid dyestuffs is effected by the salt binding of the dyestuff molecule with the peptide binding, this example is not in principle different from that described in Example 1; in practice there are, however, some differences.

A three-color design was printed on the same type of paper as was used in Example 1, using the following dyestuffs from Table A.

Telonechtbordo O
Telonechtrot BF
Telonechtmarineblau G

The dye pastes incorporating the first two dyestuffs have the same composition and are mixed in the same fashion as the dye pastes used in Example 1; with the blue color, however, a quantity of 90 g of dyestuff per kg of dye paste proved to be necessary for a proper coloring.

The woollen cloth used in this example has a weight of 110 g/m$^2$, and was impregnated in the same way as the polyamide fabric of Example 1 and dried at about 80° C. The cloth was kept under tension while drying since otherwise creases form.

The transfer of the dyestuff from the paper to the fabric was effected in the same fashion as with the polyamide.

The fastness obtained in this example was the same as that obtained by direct printing.

EXAMPLE 3

Printing on Polyacrylonitrile with Basic Dyestuffs

A Three-color design was printed on paper of the same type as was used in Example 1, using the following dyestuffs from Table B:

| | |
|---|---|
| Maxilongelb 6 GL | |
| Mixed color Maxilongelb 6 GL | 80% |
| Maxilonblau 3 RL | 20% |
| Maxilonorange 2 GL | |

The dye pastes used were of the following composition:

| Ingredient | Parts by weight |
|---|---|
| Dyestuff | 50 |
| Thickener 301 extra RF 13% | 500 |
| Water | 420 |
| Glyezin A | 30 |
| | 1000 |
| Respumiet CA 3300 | 5 |

The thickener is a cornflour ether produced by Gruenau, having a molecular weight greater than $10^6$.

The dye pastes were prepared by the following method. The dyestuff and the water were added, while stirring, to the thickener. The Glyezin A and the Respumiet CA 3300 were then added, after which the dye paste was ready for use. ware The cloth to be printed was a polyacrylonitrile knitted fabric, and was impregnated with the following mixture before printing:

| Ingredient | Parts by weight |
|---|---|
| Solvitose C 5 10% | 500 |
| Water | 450 |
| Ammonium sulphate solution 1:1 | 35 |
| Glyezin PFD | 15 |
| | 1000 |

Glyezin PFD is produced by BASF.

After impregnation the cloth was dried at a temperature of about 80° C.

The cloth was then printed with the pattern printed on the paper pattern carrier, in much the same way as in Examples 1 and 2. However, since the dyestuff was cationic rather than anionic, the polarity of the electrodes 1 and 2 was reversed. Also, the voltage used was reduced to 150V. The initial value of the current was about 5 amps; the assembly reached 100° C after between 20 and 25 seconds, and then the current fell, reaching a value of about 1 amp after about 70 seconds. Again, the colors were as fast as with direct printing followed by fixing in steam.

EXAMPLE 4

Printing on Cotton Using Reactive Dyestuffs

A four-color design was printed on paper of the same type as that used in Example 1, using the following dyestuffs from Table C; these dyestuffs are rapid fixing, anionically behaving dyestuffs Levafix rubin E-FB
Levafix goldgelb E-G
Levafix Brillantrot P-GA
Levafix brillantgelb P-3 CA The dye pastes used were of the following composition:

| Ingredients | Parts by weight |
|---|---|
| Manutex RS 4% | 650 |
| Dyestuff | 50 |
| Water | 300 |
| | 1000 |
| Respumiet CA 3300 | 5 |

Manutex RS is a sodium alginate produced by Alginate Industries Ltd.

The dye pastes were mixed by first mixing the water with the Manutex RS; the dyestuff was then added and dissolved by vigorous stirring. Finally the Respumiet was added and mixed.

A cotton cloth was impregnated with the following mixture to form the fabric to be printed:

| | |
|---|---|
| Solvitose C 5 | 500 |
| Water | 440 |
| KOH solution 1:2 | 60 |
| | 1000 |

The cloth was then dried at a temperature of about 80° C.

The cloth was then printed with the pattern printed on the paper pattern carrier, in much the same way as in Examples 1 and 2. However, in this case the voltage used was only 40 V, resulting in a current of about 1 amp and a temperature rise from 20° C to 35° C in about 1 minute. The pH value in the cloth was very high (between 13 and 14) during the printing process; again, proper fixing of the dyestuffs occurred within the period for which the voltage was applied.

EXAMPLE 5

Printing on Cottonusing Pigment Dyestuffs

A two-color design was printed on the same type of paper as was used in Example 1, using the following dyestuffs from Table D:

Acramin blue FFG
Acramin orange FG

The dye pastes used were of the following composition:

| Ingredient | Parts by weight |
|---|---|
| Solvitose C 5 10% | 500 |
| Water | 430 |
| Dyestuff | 70 |
| | 1000 |
| Respumiet CA 3300 | 5 |

The dye pastes were prepared by first mixing the solvitose C 5 solution with the water, and then stirring in the dyestuff and the anti-foaming agent.

A cotton cloth was impregnated with the following mixture, to form the material to be printed:

| Ingredient | Parts by weight |
|---|---|
| Water | 280 |
| Acramin binder CA 3187 | 75 |
| Acramin binder LG | 75 |
| Thickener CA 3241 | 10 |

-continued

| Ingredient | Parts by weight |
|---|---|
| Emulsifier CA 3240 | 10 |
| Turpentine | 500 |
| Urea | 20 |
| Ammonia | 5 |
| Respumiet CA 3300 | 3 |

The CA 3241 thickener and the CA 3240 emulsifier are Bayer products. The impregnant was prepared as follows: The urea was dissolved in water and the thickener and the emulsifier were then mixed in by stirring vigorously for 15 minutes, so that a thick paste was obtained. When this had been achieved the binding agents and then the turpentine were mixed, in, so that an emulsion was produced. The other ingredients were then added. After impregnation, the cloth were dried at a temperature of 80° C.

The cloth was then printed with the pattern printed on the paper pattern carrier, in much the same way as in Examples 1 and 2. However, in this case a voltage of 80 V was used, resulting in a current of about 3 amps. The transfer process was continued for 40 seconds, after which period the temperature of the assembly was still below 100° C. The dyestuffs were then fixed by drying the cloth at about 180° C for 10 minutes; the dyestuff molecules, which had been received by the binders with which the cloth had been impregnated, became firmly fixed during this drying by the cross-linking of the binders.

Figure 2:
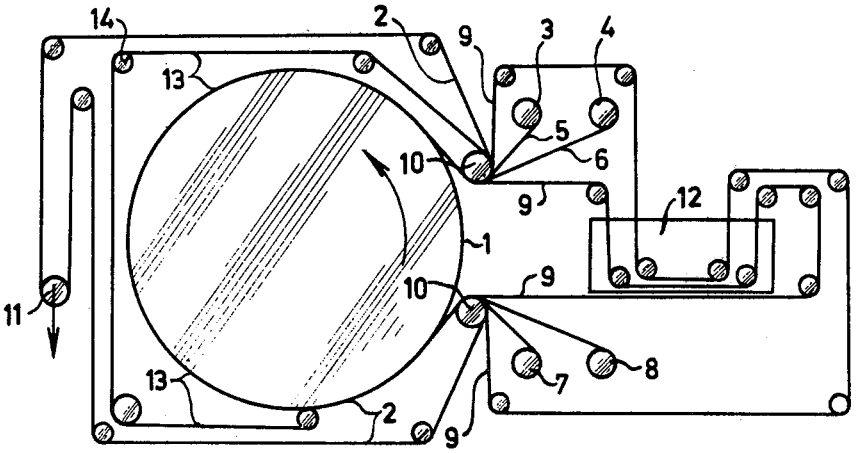

The arrangement shown in FIG. 2 can be used to carry out the electrophoretic transfer processes described above. The arrangement includes a rotatable electrically conductive drum 1' and a porous electrically conductive belt 2' which correspond to the electrodes 1 and 2 of FIG. 1. The cloth to be printed is shown at 5', and is fed from a supply roller 3 into the nip between the drum 1' and the belt 2'. The paper pattern carrier is shown at 6', and is similarly fed from a supply roller 4. The cloth and the pattern carrier are wound on to take-up rollers 7 and 8 after they have emerged from the printing process. Two endless bands 9' of absorbent material are used, corresponding to the absorbent layers 9 of FIG. 1.

As can be seen from FIG. 2, the various bands are guided by rollers so that they are brought together in the same order as the corresponding layers in FIG. 1. The bands are brought together as they pass around an upper guide roller 10, after which they pass around the drum 1'. After passing around an arc of rather more than 270° of the drum, the bands pass over a lower guide roller 10, and separate again. The conductive belt 2' then passes through a tensioning device, which is responsible for keeping the bands pressed together during the transfer process, while the two absorbent bands 9' pass through a liquid bath 12, so that they are saturated in preparation for the transfer process.

An endless tensioning belt 13 is also provided; this belt is wrapped around the outside of the conductive belt 2', around the first part of the arc of contact of the bands with the drum 1'. The belt 13 is guided by rollers 14.

The transfer printing process is carried out by applying the appropriate voltage between the drum 1' and the belt 2', and rotating the drum at such a speed that the bands remain in contact with the drum for the period needed for the transfer process to be completed. For example, if using a process such as that described in Example 1 above, the drum 1' would make three-quarters of a turn in 60 seconds.

The steam produced during the process escapes through the porous conductive belt 2' around the last part of the arc of contact with the drum 1', after the tensioning belt 13 has separated from the belt 2'. This assists in producing a slightly sharper pattern, in comparison with the arrangement shown in FIG. 1, in which the steam escapes laterally.

Although the foregoing description refers only to dyestuffs, and only to the transfer of dyestuffs which are printed in a pattern, it is to be understood that my invention could be applied to the transfer of other chemicals, and to the transfer of dyestuffs or chemicals over the whole surface of the material to be printed.

It is also possible that, in the apparatus of FIG. 2, the belt 2' could be used as a pattern carrier, being printed afresh in the part of its length which is not wrapped around the drum 1'.

What I claim is:

1. An electrophoretic transfer process, comprising the steps of:

impregnating a receiving material with a thickening agent having a molecular weight exceeding $1 \times 10^6$;

drying the receiving material;

contacting a carrier material containing the substance to be transferred with a receiving material in the presence of a moist environment; and applying an electric field across said carrier material and said receiving material.

2. A process as in claim 1 in which the substances to be transferred are dyestuffs.

3. A process as in claim 1, in which the receiving material is a textile material.

4. A process as in claim 1 wherein said step of drying includes the step of heating the receiving material.

5. A process as in claim 1 wherein said step of impregnating includes the addition of a fixing agent to said thickening agent.

6. A process as in claim 5 further comprising the step of applying pressure to said carrier material and said receiving material during said step of applying an electric field.

7. A method as in claim 6 in which the carrier material is used as an electrode for applying the electric field.

8. A method as in claim 7 further comprising the step of guiding the carrier material and the receiving material to travel along paths which coincide along a transfer section, along which both said materials move between the moist absorbent surfaces while being subjected to the electric field.

9. A method as claimed in claim 8, in which the transfer section comprises a major part of the circumference of a rotatable drum, and the two moist absorbent surfaces comprise two endless absorbent belts which are wrapped around the transfer section, the remainder of the length of the belts being guided to travel in a path which passes through a liquid bath, and the carrier material and the receiving material are in the form of elongate bands which are guided to pass around the transfer section between the absorbent belts, and in which process a conductive belt is wrapped around the outside of the absorbent belts along the transfer section to form an electrode for applying the electric field.

10. A method as claimed in claim 9 in which the conductive belt is provided with tensioning means.

* * * * *